US006026271A

United States Patent [19]

Saitoh

[11] Patent Number: 6,026,271

[45] Date of Patent: Feb. 15, 2000

[54] IMAGE FORMING APPARATUS WITH IMPROVED CLEANING CAPABILITY

[75] Inventor: Masato Saitoh, Kashiwazaki, Japan

[73] Assignee: NEC Corporation, Japan

[21] Appl. No.: 09/290,041

[22] Filed: Apr. 12, 1999

[30] Foreign Application Priority Data

Apr. 14, 1998 [JP] Japan ..... 10-102976

[51] Int. Cl.[7] ..... G03G 15/16; G03G 21/00

[52] U.S. Cl. ..... 399/308; 399/345; 399/349; 399/357

[58] Field of Search ..... 399/302, 308, 399/349, 357, 350, 345

[56] References Cited

U.S. PATENT DOCUMENTS

| | | | |
|---|---|---|---|
| 4,711,549 | 12/1987 | Roodbeen | 399/308 |
| 4,899,198 | 2/1990 | Mahoney | 399/302 |
| 5,079,592 | 1/1992 | Kanis | 399/302 |
| 5,173,735 | 12/1992 | Kusumoto | 399/302 |
| 5,510,886 | 4/1996 | Sugimoto et al. | 399/308 |

FOREIGN PATENT DOCUMENTS

| | | |
|---|---|---|
| 59-87475 | of 1984 | Japan . |
| 6102778 | of 1994 | Japan . |
| 9-62111 | of 1997 | Japan . |
| 9114269 | of 1997 | Japan . |
| 9251249 | of 1997 | Japan . |
| 9258631 | of 1997 | Japan . |

*Primary Examiner*—Susan S. Y. Lee
*Attorney, Agent, or Firm*—Ostrolenk, Faber, Gerb & Soffen, LLP

[57] ABSTRACT

An image forming apparatus is capable of effectively removing a residual toner on a surface of an intermediate transfer roller by a cleaning roller and a predetermined plate form blade without injuring the surface of the intermediate transfer roller. In the electrophotographic type image forming apparatus, the cleaning roller rotates in an opposite direction to the rotating direction of the intermediate transfer roller and is provided in contact with the surface of the intermediate transfer roller. Also, a plate form blade contacting with the cleaning roller is provided. Also, at least the cleaning roller is movable toward and away from the intermediate roller.

12 Claims, 4 Drawing Sheets

IMAGE FORMING APPARATUS WITH IMPROVED CLEANING CAPABILITY

BACKGROUND OF THE INVENTION

1. Field of the Invention

The present invention relates generally to an image forming apparatus. More particularly, the invention relates to an image forming apparatus having an intermediate transfer roller.

1. Description of the Related Art

An image forming apparatus develops a latent image formed on a photo conductor through an electrophotographic process by a toner to form a toner image. In the image forming apparatus having an intermediate transfer roller, the toner image is once carried on the intermediate roller and then transferred and fixed to a printing medium.

In such image forming apparatus, even after transferring the toner image to the printing medium from the intermediate transfer roller, toner may reside on the surface of the intermediate roller for various reason, such as the deposition of flying toner on an unnecessary portion or deposition of excessive toner due to deterioration of a developer or from other sources.

The residual toner is composed in the image that should be formed, in the successive printing process causes degradation of a printed image.

Conventionally, in order to remove such residual toner, there has been proposed a technology, in which a cleaning blade contacts with the intermediate transfer roller under pressure and removes the residual toner on the surface of the intermediate transfer roller (Japanese Unexamined Patent Publication No. Heisei 9-114269).

However, when the cleaning blade contacts with the intermediate transfer roller and scraps the toner residing off the surface of the intermediate transfer roller, the cleaning blade directly contacts the intermediate transfer roller under pressure. When this occurs, it is possible to form a scratch on the surface of the intermediate transfer roller during a long period of use.

On the other hand, due to the possibility of a formation of a scratch, the cleaning blade cannot be urged onto the intermediate transfer roller with sufficient force. This causes difficulty in performing a satisfactory cleaning.

Also, in order to reduce the contact area, there is a technology to employ a brush form roller. However, such brush form roller may cause stripe form scratches on the intermediate transfer roller to make a stripe-like pattern to appear on the printed image to cause degradation of quality of the image.

SUMMARY OF THE INVENTION

The present invention was designed for solving such a problem in the prior art. Therefore, it is an object of the present invention to provide an image forming apparatus which can remove residual toner on a surface of an intermediate transfer roller without causing a scratch on the surface of the intermediate transfer roller.

Another object of the present invention is to provide an image forming apparatus which can satisfactorily remove toner on the surface of the intermediate roller by establishing contact between a cleaning means and the intermediate transfer roller with sufficient force.

A further object of the present invention is to provide a power-saving type image forming apparatus which can prevent the cleaning apparatus from becoming inoperative even if toner is solidified at a low temperature by enabling the cleaning means to contact with and release from the intermediate roller, and thus can restrict the load caused upon initiation of operation of the image forming apparatus.

In order to accomplish the above-mentioned and other objects, an image forming apparatus, according to one aspect of the present invention, comprises a belt form photo conductor, a charger for charging the photo conductor, an exposer for forming a latent image on the charged photo conductor, a developer forming a visual image based on the latent image, an intermediate transfer roller temporarily carrying the visual image by contacting with the photo conductor, a fixing roller for fixing the visual image transferred from the intermediate transfer roller to the printing medium, a toner supplier supplying a toner to be used in formation of the visual image to the developer, and cleaning means for performing cleaning of the intermediate transfer roller. The cleaning means being constructed with a cleaning roller rotating in a direction opposite to rotating direction of the intermediate roller and contacting with a surface of the intermediate transfer roller, and a plate form blade contacting with the cleaning roller at a predetermined position without contacting with the intermediate transfer roller.

The cleaning roller which is rotatable, contacts with the intermediate transfer roller with rotation in an opposite direction to the rotating direction of the intermediate transfer roller. Therefore, the cleaning roller can perform cleaning by contacting with the intermediate transfer roller without causing resistance.

The plate form blade contacts with the cleaning roller instead of the intermediate transfer roller to scrape the residual toner off the surface of the cleaning roller for collection. Therefor, the residual toner on the surface of the intermediate transfer roller can be satisfactorily removed without damaging the surface of the intermediate transfer roller.

The plate form blade has an edge portion contacting with the surface of the cleaning roller for cleaning the surface of the cleaning roller. The edge portion of the plate form blade abuts onto the surface of the cleaning roller in angled position. In this case, it is preferred that a tip end of the edge portion of the plate form blade is oriented toward a direction opposite to the rotating direction of the cleaning roller.

The cleaning roller and the plate form blade may be arranged so that a contact point between the cleaning roller and the plate form blade is located on an extension of a straight line extending through a central point of the intermediate transfer roller and a central point of the cleaning roller.

With this arrangement, the cleaning roller is preferably contacted with the intermediate transfer roller and the plate form blade at mutually point symmetric positions relative to the rotational axis of the cleaning roller. Thus, the cleaning roller is biased by both of the intermediate transfer roller and the plate form blade. Thus, the cleaning roller and the intermediate transfer roller contact intimately.

On the other hand, by an arrangement where the rotational axis and contact point are arranged in alignment, positioning of the intermediate transfer roller and the plate form blade can be facilitated.

Furthermore, the intermediate transfer roller, the cleaning roller and the plate form blade are arranged so that a straight line extending across the central point of the intermediate transfer roller and the central point of the cleaning roller may be in parallel to a transporting path of a printing medium.

Accordingly, a depression force to be caused between the cleaning roller and the intermediate transfer roller during cleaning will never affect for a force to be created between the intermediate transfer roller and the printing medium during printing. Thus, sufficient depression force may be applied on the cleaning roller to intimately contact with the intermediate transfer roller. Thus, cleaning of the intermediate roller can be performed satisfactorily with maintaining quality of printed image.

On the other hand, the transporting path of the printing medium is frequently oriented in the longitudinal direction of the apparatus. Corresponding to this, the intermediate transfer roller, the cleaning roller and the plate form blade can be arranged in the longitudinal direction.

When the cleaning roller of the cleaning means is provided for movement toward and away from the intermediate transfer roller, the cleaning roller may contact with the intermediate transfer roller only upon cleaning of the intermediate transfer roller and may be held away from the intermediate transfer roller otherwise.

The cleaning roller contacts with the surface of the intermediate transfer roller at some position thereon. The contact position and the position of the cleaning roller as placed away from the intermediate transfer roller may be determined relative to the arrangement of other components.

In this case, the plate form blade is appropriately arranged to contact with surface of the cleaning roller when the cleaning roller contacts with the intermediate transfer roller.

The reason why the cleaning roller is provided for movement toward and away from the intermediate transfer roller, is that when the toner is made of a material which is molten at high temperature and solidified at low temperature, if the cleaning roller and the intermediate transfer roller are held in pressure contact after cleaning, exuded toner may be solidified to mutually stick the cleaning roller and the intermediate transfer roller to make them inoperative. In such case, extra power is required in initiation of operation.

By making the cleaning roller movable toward and away from the intermediate transfer roller, sticking between the cleaning roller and the intermediate transfer roller to make them inoperative can be successfully prevented. Thus, extra load will never be exerted on the apparatus upon initiation of operation.

In case of the cleaning means where the cleaning roller and the plate for blade are integrated, the cleaning means is moved toward and away from the intermediate transfer roller.

Even in this case, what is in direct contact with the intermediate transfer is the cleaning roller. This cleaning means contacts on some position on the surface of the intermediate transfer roller.

When the cleaning roller and the plate form blade are integrally contacting with the intermediate transfer roller, the cleaning roller may sufficiently urged onto the intermediate transfer roller.

The image forming apparatus may further comprise biasing means for urging the cleaning roller onto the intermediate transfer roller under pressure, and biasing means for urging the plate form blade onto the cleaning roller under pressure.

By this, contacting between the cleaning roller and the intermediate transfer roller and contacting between the plate form blade and the cleaning roller can be successfully established. This is effective in both an image forming apparatus, in which the cleaning roller or the cleaning means is fixed and an image forming apparatus, in which the cleaning roller or the cleaning means is movable toward and away from the intermediate transfer roller.

When the plate form blade is formed with an elastic body, the plate form blade may contact with the cleaning roller with sufficient elasticity to absorb shock or so forth to be caused upon contacting with the intermediate transfer roller.

On the other hand, the plate form blade formed of elastic body acts together with the biasing means provided in addition to keep it constantly contact with the cleaning roller.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. Moreover, well-known structures are not shown in detail in order to avoid unnecessarily obscuring of the present invention.

Figure 1:
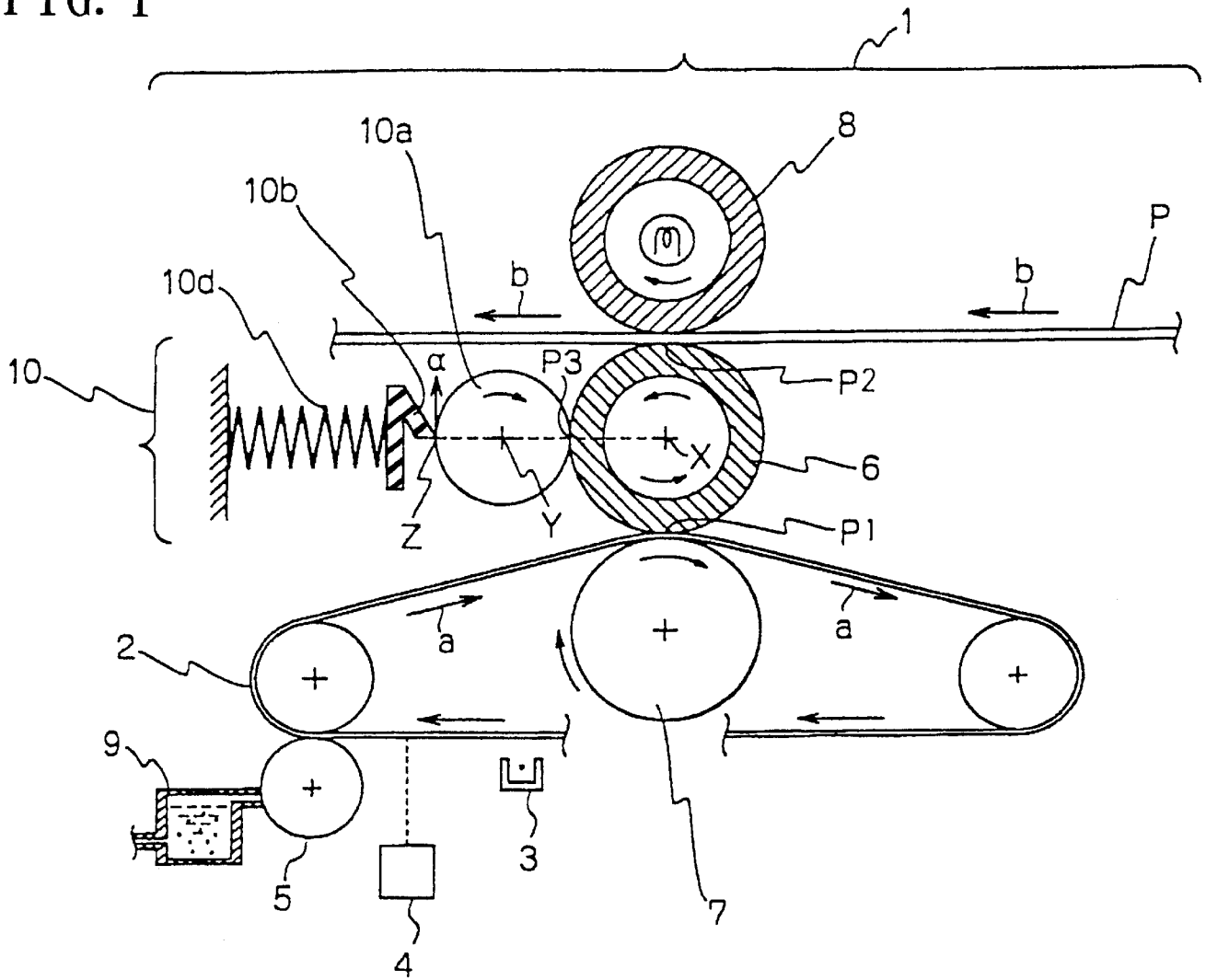
FIG. 1 is a section showing a construction of the first embodiment of an image forming apparatus according to the present invention.

FIG. 1 is a section showing a construction of the first embodiment of an image forming apparatus 1 according to the present invention. The image forming apparatus 1 includes a an endless belt form photo conductor 2 and a charger 3 charging the belt form photo conductor 2. An exposer 4 performs exposure of image data on the charged belt form photo conductor 2 for forms a latent image. A developer 5 forms a visual image with a toner based on the formed latent image. An intermediate transfer roller 6 carries visual image and transfers it onto a printing medium P. A transfer assists roller 7 assisting contact between the intermediate transfer roller 6 and the belt form photo conductor 2. A fixing roller for heating and pressurizing the visual image on the printing medium P for fixing is also provided. A toner supplier 9 filled with a toner T to be used in formation of the visual image feeds developer 5. A cleaning means is provided including a cleaning roller 10*a* to be contacted with the intermediate transfer roller 6 under pressure by a biasing means 10*d* and a plate form blade 10*b* contacting the cleaning roller 10*a* under pressure at a predetermined position.

Next, discussion will be given for each component forming the first embodiment of the image forming apparatus according to the present invention.

The photo conductor 2 is supported on a plurality of belt supporting rollers and connected in an endless form, and is formed into a belt form moving in a direction of arrow a.

The charger 3 applies a given initial potential to the belt form photo conductor 2. The exposer 4 exposes the belt form photo conductor 2 on the basis of an image data to a light source, such as a laser, an LED, a liquid crystal or so forth, to form a latent image. The latent image is converted into a visual image by the deposition of toner T. The toner supplier 9 stores toner and supplies a predetermined amount of toner to the developer 5 upon use.

The intermediate transfer roller 6 contacts with the photo conductor 2 at a position P1. The intermediate transfer roller 6 once carries the visual image formed on the surface of the photo conductor 2 and contacts with the printing medium P at a position P2. The intermediate transfer roller 6 is rotatably provided for contacting over the entire width of the belt form photo conductor 2.

The transfer assisting roller 7 is arranged in parallel to the intermediate transfer roller 6 across the belt form photo conductor 2. Namely, the transfer assisting roller supports the belt form photo conductor 2 from the back side to maintain a tension of the later. In conjunction therewith, the transfer assisting roller 7 urges the belt form photo conductor 2 onto the intermediate transfer roller 6 with a given pressure for satisfactorily transferring the visual image on the surface of the photo conductor 2 to the intermediate transfer roller 6.

A fixing roller 8 is arranged in parallel to the intermediate transfer roller 6 across a transporting path of the printing medium P. Namely, the fixed roller 8 pushes the printing medium P from the back side at the position P2 to urge the printing medium P onto the intermediate transfer roller 6 at a given temperature and a given pressure for transferring the visual image on the surface of the intermediate transfer roller onto the printing medium P.

As shown in FIG. 1, a force in a perpendicular direction is exerted at the position P2 across the printing medium P to the fixing roller 8 and the intermediate transfer roller 6. In order to bear the force in the perpendicular direction, the transporting path of the printing medium P is provided in a horizontal direction. The direction of the force to be exerted on the intermediate transfer roller 6 and the printing medium P intersects perpendicularly with the direction of the transporting path with an angle of 90°. Thus, the force to be exerted on the intermediate transfer roller 6 and the printing medium P will never influence the transportation of the printing medium P.

The cleaning means 10 is adapted to remove the residual toner on the surface of the intermediate transfer roller 6. The cleaning means 10 is constituted of a cleaning roller 10*a* for directly cleaning the surface of the intermediate transfer roller 6 by contacting with the surface of the intermediate transfer roller 6, and a plate blade 10*b* for cleaning the surface of the cleaning roller 10*a* by contacting with the cleaning roller 10*a* (but not contact with the intermediate transfer roller).

The rotatable cleaning roller 10*a* contacts with the intermediate transfer roller 6 with rotation in an opposite direction to that of the intermediate roller 6 so as not to cause a resistance on the surface of the intermediate transfer roller 6.

On the other hand, the intermediate transfer roller 6 is rotated in the same direction as rotary shafts of the transfer assisting roller 7, the fixing roller 8 and the cleaning roller 10*a,* and is disposed between the transfer assisting roller 7 and the fixing roller 8.

By driving the belt form photo conductor 2 (in the direction a) with the construction set forth above, the intermediate transfer roller 6 and the fixing roller 8 are driven to rotate according to travel of the belt form photo conductor 2. The cleaning roller 10*a* contacting with the intermediate transfer roller 6 is driven to rotate according to rotation of the intermediate transfer roller 6. Thus, by driving only belt form photo conductor 2, all of the intermediate transfer roller 6, the transfer assisting roller 7, the fixing roller 8 and the cleaning roller 10*a* are driven to rotate. Therefore, the printing medium P is transported in a direction of arrow b. Then, the image is formed on the printing medium while it is transported.

The cleaning roller 10*a* may be arranged at any position within a range from a contact point P2 (FIG. 1) of the intermediate transfer roller 6 to a contact point P1 on the surface of the cleaning roller 10*a* (FIG. 1) along the rotating direction as long as it does not cause interference with the photo conductor 2 and the printing medium.

The plate form blade 10*b* has an edge portion to contact with the cleaning roller 10*a*. The edge portion contacts with the surface of the cleaning roller 10*a* for removing toner T on the surface of the cleaning roller 10*a*. In the contacted condition, it is desired that the orientation of the tip end of the edge portion of the plate form blade 10*b* is directed in a direction opposite to the rotating direction of the cleaning roller 10*a*.

As shown in FIG. 1, at a contact point Z between the plate form blade 10*b* and the cleaning roller 10*a,* when an angle relative to a tangent line a drawn toward the rotating direction of the cleaning roller 10*a* is less than or equal to 90°, toner can be satisfactorily removed from the surface of the cleaning roller 10*a*. The contact angle is determined appropriately in consideration of a material of the surface of the cleaning roller, and elastic modules of the plate form blade 10*b*.

The plate form blade 10*b* scrapes the residual toner off the surface of the cleaning roller 10*a* by contacting the cleaning roller 10*a* instead of the intermediate transfer roller 6. Accordingly, toner residing on the surface of the intermediate transfer roller 6 can be removed without forming scratches on the surface of the intermediate transfer roller 6.

Next, arrangement of the intermediate transfer roller 6, the cleaning roller 10*a,* and the plate form blade 10*b* will be discussed.

In the first embodiment, the intermediate transfer roller 6, the cleaning roller 10*a* and the plate form blade 10*b* are arranged so that a contact point Z, between the cleaning roller 10*a* and the plate form blade 10*b,* is located at a position on an extension of a straight line extending through the central point X of the intermediate transfer roller 6 and the central point Y of the cleaning roller 10*b*.

In this arrangement, the cleaning roller 10*a* is contacted with the intermediate transfer roller 6 and the plate form blade 10*b* under pressure at positions (P3, Z) which are symmetric relative to the central point Y thereof.

The cleaning roller 10*a* is thus pushed by both of the intermediate transfer roller 6 and the plate form blade 10*b*. Thus, the cleaning roller 10*a* may intimately contact with the intermediate transfer roller 6 at the position P3.

On the other hand, positional relationship between the cleaning roller 10*a,* the intermediate transfer roller 6 and the plate form blade 10*b* can be clearly defined. Thus, exchanging, assembling, maintenance and adjustment of the cleaning roller 10*a* can be facilitated.

Furthermore, as shown in FIG. 1, the intermediate transfer roller 6, the cleaning roller 10*a* and the plate form blade 10*b* are arranged so that a straight line extending across the rotational center X of the intermediate transfer roller 6, the rotational center Y of the cleaning roller 10*a* and the contact point Z between the cleaning roller 10*a* and the plate form blade 10*b,* is in parallel to the transporting path of the printing medium P.

By the arrangement set forth above, the direction (vertical direction) of the force to be exerted by the intermediate transfer roller 6 and the fixing roller 8 located in opposition across the printing medium P as shown in FIG. 1 at the position P2, and the direction (horizontal direction) of the force to be exerted from the intermediate transfer roller 6 and the plate form blade 10*b* located on both sides of the cleaning roller 10*a,* at the position P3, intersects perpendicularly with an angle of 90°.

Therefore, the force to be exerted on the intermediate roller 6 from the cleaning roller 10*a* during cleaning operation will never cause interference with the force to be created between the intermediate transfer roller 6 and the printing medium P during printing. Thus, the cleaning roller 10*a* can be urged toward the intermediate transfer roller 6 with a sufficient magnitude for establishing intimate contact therebetween.

In order to maintaining a printed image quality, it is required that the transfer roller and the fixing roller located on both sides of the printing medium P constantly contact in a uniform condition during transferring and fixing process. Contact of the cleaning roller 10*a* will never affect for image printing. Thus, cleaning of the intermediate transfer roller can be done satisfactorily.

On the other hand, the transporting path of the printing medium P can be oriented in the longitudinal direction of the apparatus. Corresponding to this, the intermediate transfer roller 6, the cleaning roller 10*a* and the plate form blade 10*b* are arranged in parallel to permit down-sizing of the apparatus.

On the other hand, it is desirable that biasing means for intimate contact, such as a leaf spring, a coil spring or so forth for the plate form blade 10, and biasing means for intimate contact, such as a coil spring or so forth for the cleaning roller 10*a* be provided to establish intimate contact between the cleaning roller 10*a* and the intermediate transfer roller 6 and between the plate form blade 10*b* and the cleaning roller 10*a*. In the shown embodiment, as shown in FIG. 1, biasing means 10*d* provides the intimate contact, which can push the cleaning roller 10*a* together with the plate form blade 10*b*.

It should be noted that, in the image forming apparatus, in which the cleaning roller 10 is stationary, it is preferable to provide a heat source for the intermediate transfer roller 6. When the toner is a material which is molten at high temperatures and solidifies at low temperature, the residual toner on the surface of the intermediate transfer roller 6 is solidified upon lowering of the temperature to prevent the intermediate transfer roller 6 from becoming not rotatable.

In such first embodiment, the latent image formed on the belt form photo conductor 2 becomes a visual image through deposition of toner. Then, the visual image is transferred from the photo conductor 2 to the intermediate transfer roller 6 at the position P1. Then, the transfer assisting roller 7 pushes the photo conductor 2 onto the intermediate transfer roller 6 with vertically upward force. The visual image is thus temporarily transferred to the intermediate transfer roller 6 which rotates in a counterclockwise direction at the point P2 for transferring the visual image to the printing medium P. The fixing roller depresses; the printing medium P onto the intermediate transfer roller 6 by a vertically downward force to form the image.

After formation of the image, the toner T residing on the surface of the intermediate transfer roller 6 is removed by the cleaning roller 10*a* depressed onto the intermediate transfer roller 6 under pressure, at the position P3. Then, the plate form blade 10*b* contacts with the cleaning roller 10*a* to scrape the toner off the surface of the cleaning roller 10*a* at the contact point Z.

Since the intermediate transfer roller 10*a* is in merely surface contact with the cleaning roller 10*b* which is in rotating in the opposite direction, the surface of the intermediate transfer roller 10*a* may not be damaged in the form of a scratch which results in degradation of the printed image.

On the other hand, by employing the particular arrangement of the intermediate transfer roller 6, the cleaning roller 10*a* and the plate form blade 10*b* as set forth above, the cleaning roller 10*a* can be urged onto the intermediate transfer roller 6 with sufficient force for satisfactorily cleaning, without affecting for quality of the printed image.

Next, the second embodiment of the image forming apparatus according to the present invention will be discussed with reference to FIGS. 2 and 3.

The second embodiment is characterized by providing the cleaning means 10A to be movable toward and away from the intermediate transfer roller 6A by providing a driving means 10Ac.

On the other hand, it is also possible to make only cleaning roller 10Aa movable toward and away from the intermediate transfer roller 6A instead of moving the overall cleaning means 10A. In such an arrangement the plate form blade 10Ab remains fixed.

In the shown embodiment, the cleaning means 10A is movable toward and away from the intermediate transfer roller 6A so that the cleaning roller 10A may be moved away from the intermediate transfer roller 6A after cleaning. Such a construction, prevents the cleaning roller and the intermediate transfer roller from beginning stuck together and inoperative due to exuding of the residual toner removed from the intermediate transfer roller by the cleaning roller caused by solidification when the temperature is lowered.

Moreover, in the shown embodiment, a load of the apparatus caused by sticking of the cleaning roller and the intermediate transfer roller, will not be caused during initiation of operation of the apparatus thereby achieving a power-saving of the image forming apparatus.

Figure 2:
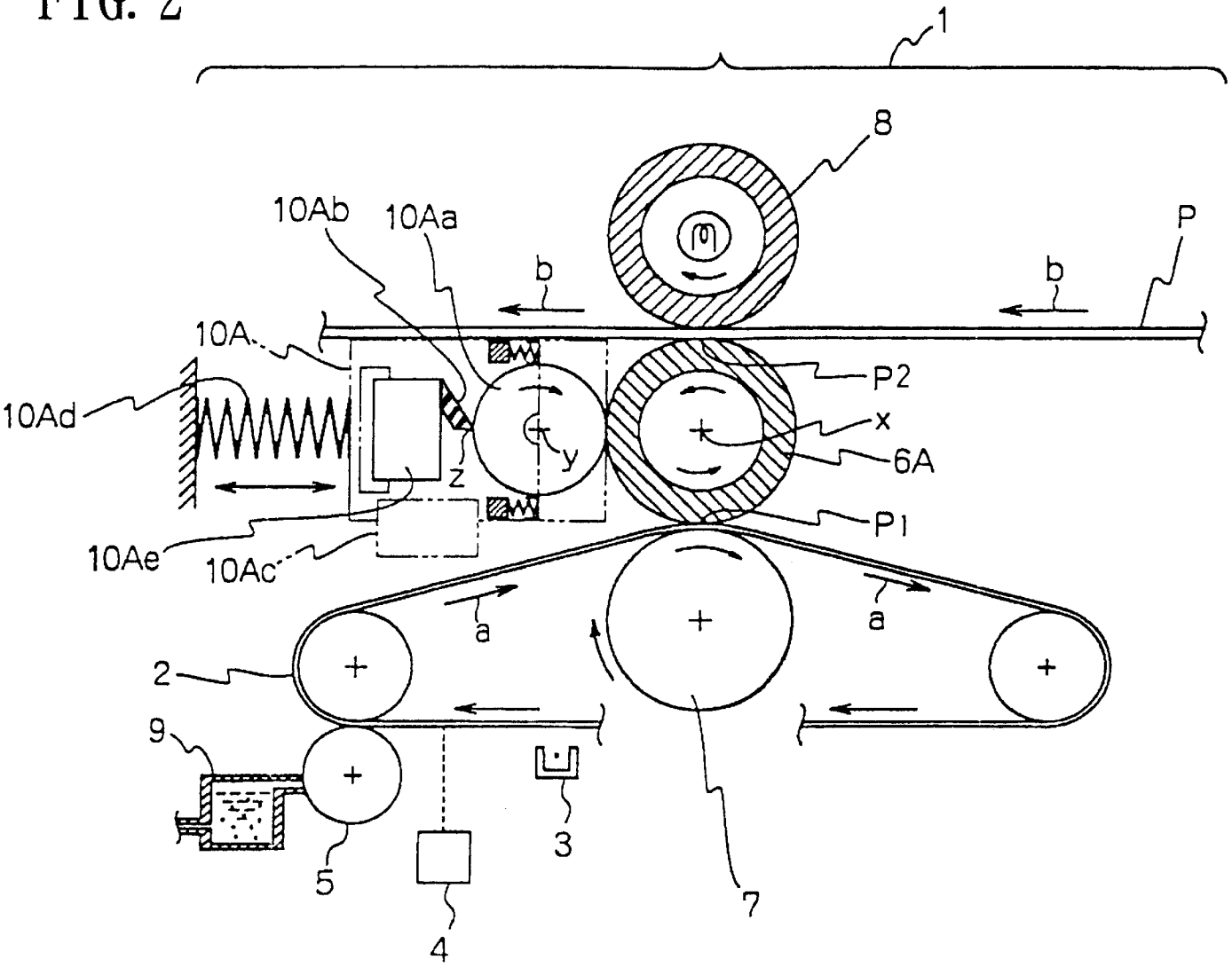
FIG. 2 is a section showing a construction showing a condition where a cleaning means is contacting with an intermediate transfer roller in the second embodiment of the image forming apparatus according to the present invention.

FIG. 2 shows the second embodiment of the image forming apparatus according to the present invention, where the cleaning means 10A is in contact with the intermediate transfer roller 6A. Namely, FIG. 2 shows the second embodiment of the image forming apparatus during cleaning.

The intermediate transfer roller 6, the cleaning roller 10Aa and a plate form blade 10Ab are arranged so that the central point X of the intermediate transfer roller 6A, the central point Y of a cleaning roller 10Aa and the contact point Z of the cleaning roller and the plate form blade 10Ab are aligned on a straight line.

The cleaning roller 10Aa is urged onto the intermediate transfer roller 6A by one biasing means 10Ad for pressure contact together with the plate form blade 10Ab. Thus, the residual toner on the surface of the intermediate transfer roller can be removed satisfactorily and collected in a waste toner container 10Ae.

Figure 3:
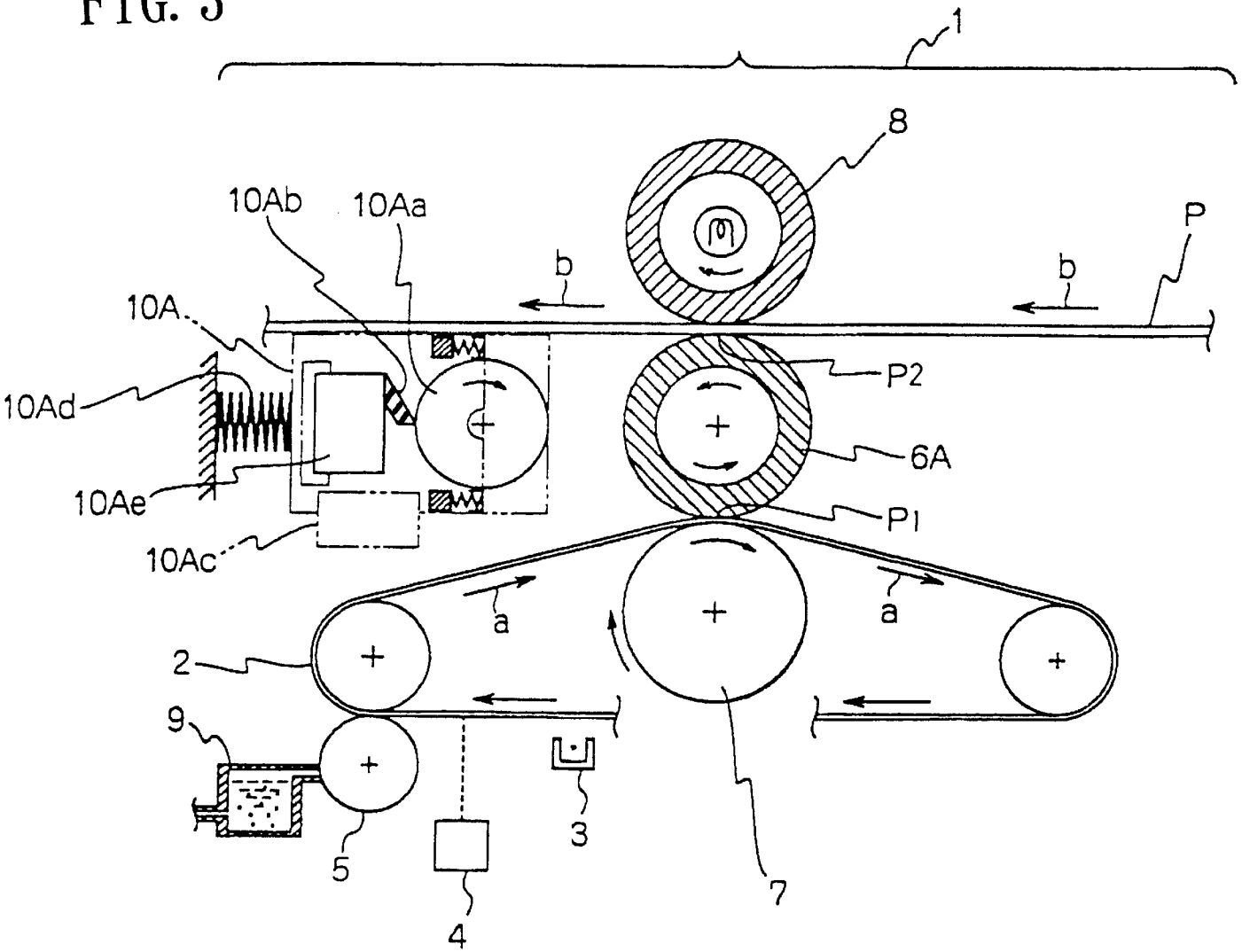
FIG. 3 is a section showing a construction showing a condition where the cleaning means is released from intermediate transfer roller in the second embodiment of the image forming apparatus according to the present invention.

FIG. 3 also shows the second embodiment of the image forming apparatus where the cleaning means 10A is moved away from the intermediate transfer roller 6A. Namely, FIG. 3 shows the second embodiment of the image forming apparatus where cleaning is not performed.

In the second embodiment, the cleaning means 10A is integral. The cleaning means 10A contacts with the intermediate transfer roller 6A only during cleaning of the intermediate transfer roller 6A. Upon printing of the image, the cleaning means 10A is placed away from the intermediate transfer roller 6A.

Figure 4:
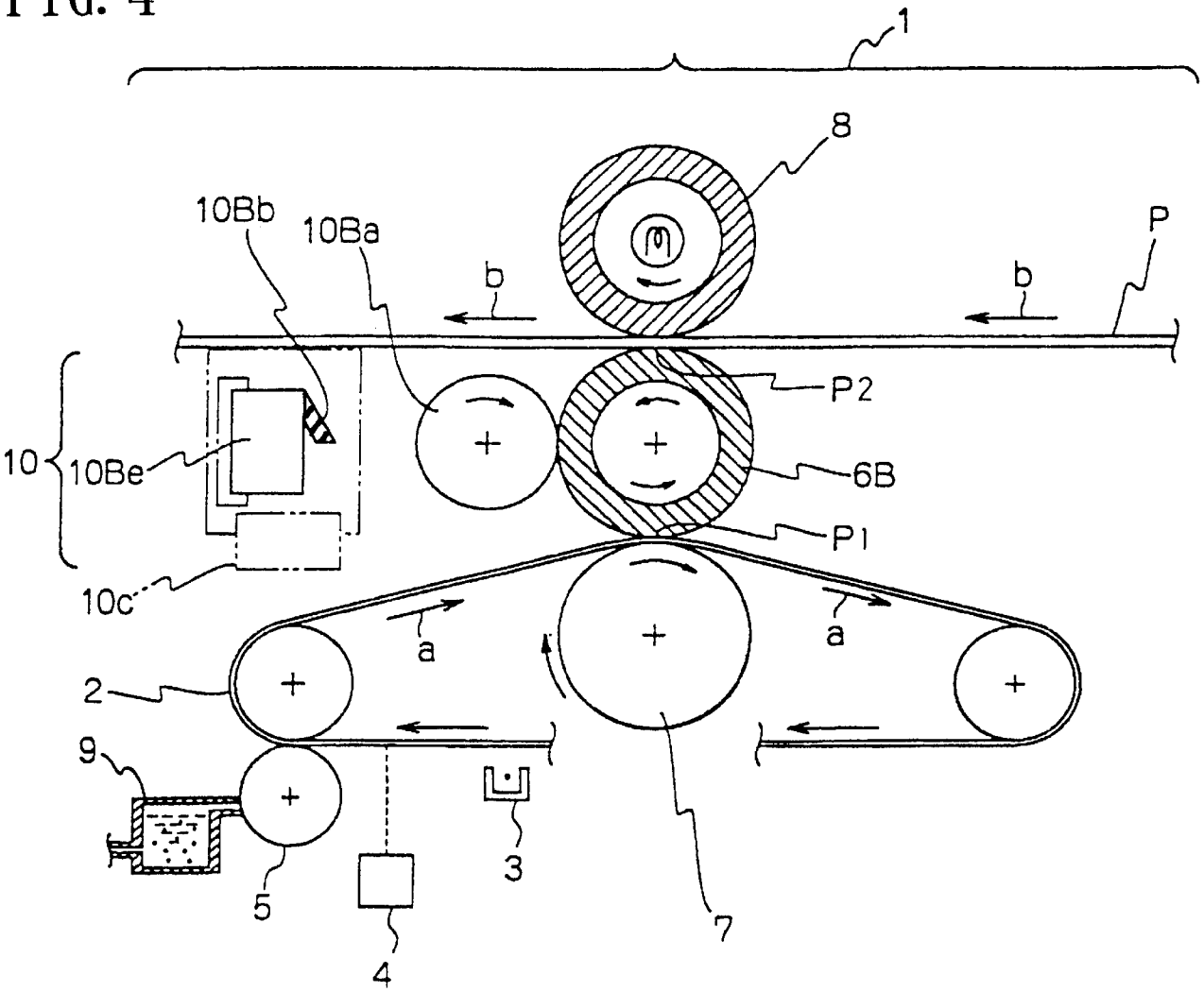
FIG. 4 is an illustration showing a construction of the third embodiment of the image forming apparatus according to the present invention, in which a plate form blade forming the cleaning means is moved toward and away from a cleaning roller.

FIG. 4 shows the third embodiment of the image forming apparatus according to the present invention, in which a plate form blade 10Bb of the cleaning means is provided for moving toward and away from a cleaning roller 10Ba.

By moving the plate form blade 10Bb of the cleaning means toward and away from the cleaning roller 10Ba, when the plate form blade 10Bb is in contact with the cleaning roller 10Ba, the cleaning roller 10Ba is urged toward an intermediate transfer roller 6B to establish intimate contact to successfully remove the toner from the surface of the intermediate transfer roller 6B.

Thus, even when the overall cleaning means is not driven, the cleaning roller 10Ba may contact with the intermediate transfer roller 6B only upon cleaning similar to the second embodiment. Thus, cleaning roller 10Bb which is worn significantly, can be easily exchanged.

Since the present invention is constructed as set forth above, in that the plate form blade forming the cleaning means does not contact directly to the intermediate transfer roller, the surface of the intermediate transfer roller will never be injured while satisfactorily removing toner to maintain the image quality of the image forming apparatus.

Also, by arranging the central point of the cleaning roller on the extension of the straight line extending across the central point of the intermediate transfer roller and the contact point of the predetermined plate form blade, the cleaning roller can be contacted with the intermediate transfer roller with sufficient depression force.

On the other hand, by making the positional relationship clear, assembling, maintenance and exchanging in the image forming apparatus can be facilitated.

Also, by arranging the straight line extending across the central point of the intermediate transfer roller and the contact point between the cleaning roller and the plate form blade in parallel to the transporting path of the printing medium, the force in the vertical direction to be exerted on the printing medium and the intermediate transfer roller (fixing roller) and the force of the horizontal direction to be exerted on the intermediate transfer roller and the cleaning roller (plate form blade) intersect perpendicularly, these forces thus do not interfere with each other. Thus, the cleaning roller may be applied with sufficient depression force to successfully perform cleaning.

Furthermore, since the transporting path of the printing medium, the intermediate transfer roller, the cleaning roller and the plate form blade are arranged in the longitudinal direction of the apparatus, volume ratio of the parts can be made high to realize a compact image forming apparatus.

The present invention can prevent necessary fixing of the cleaning roller and the intermediate transfer roller even if the toner is solidified at low temperature thus making it impossible for the rollers to rotate. This is accomplished by making the cleaning means movable toward and away from the intermediate transfer roller.

By this, the power-saving type image forming apparatus can be provided by restricting the load to be exerted upon the image forming apparatus at initiation of operation.

By additionally providing the biasing means for urging the cleaning roller onto the intermediate transfer roller, the cleaning roller may intimately contact with the intermediate transfer roller. On the other hand, by additionally providing the biasing means for urging the plate form blade onto the cleaning roller, or by forming the plate form blade with an elastic body, the plate form blade can intimately contact with the cleaning roller.

By this, it is possible to provide the image forming apparatus which can achieve high printing quality by enabling the cleaning roller to satisfactorily remove the residual toner on the surface of the intermediate transfer roller, by enabling the plate form blade to satisfactorily remove the removed toner deposited on the surface of the cleaning roller so as not to reside the toner on the intermediate transfer roller, and by eliminating influence of the residual toner.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the features set out in the appended claims.

What is claimed is:

1. An image forming apparatus comprising:

a photo conductor;

a charger which charges said photo conductor to produce a charged photo conductor;

an exposer which forms a latent image on said charged photo conductor;

a developer which forms a visual image based on said latent image;

an intermediate transfer roller which temporarily carries said visual image by contacting with said photo conductor;

a fixing roller which fixes said visual image, which was transferred from said intermediate transfer roller, to a printing medium;

a toner supplier which supplies toner to said developer to be used in formation of said visual image;

a cleaner which cleans said intermediate transfer roller, said cleaner being constructed with a cleaning roller rotating in a direction opposite to a rotating direction of said intermediate transfer roller, said cleaning roller further contacting with a surface of said intermediate transfer roller; and a plate form blade contacting with said cleaning roller at a predetermined position without contacting with said intermediate transfer roller, wherein a contact point between said cleaning roller and said plate form blade is located on a straight line which also extends through a central point of said intermediate transfer roller and a central point of said cleaning roller.

2. An image forming apparatus as set forth in claim 1, wherein a tip end of an edge portion of said plate form blade is oriented toward a direction opposite to the rotating direction of the cleaning roller.

3. An image forming apparatus as set forth in claim 1, wherein said straight line extending across said central point of said intermediate transfer roller and said central point of said cleaning roller is in parallel to a transporting path of said printing medium.

4. An image forming apparatus as set forth in claim 1, wherein said cleaner is movable toward and away from said intermediate transfer roller.

5. An image forming apparatus as set forth in claim 1, wherein said cleaning roller is movable toward and away from said intermediate transfer roller.

6. An image forming apparatus as set forth in claim 1, which further comprises a biasing member which urges said cleaning roller onto said intermediate transfer roller under pressure.

7. An image forming apparatus as set forth in claim 1, which further comprises a biasing member which urges said plate form blade onto said cleaning roller under pressure.

8. An image forming apparatus as set forth in claim 1, wherein said plate form blade is formed with an elastic body.

9. The image forming apparatus as claimed in claim 1 wherein said photo conductor is in a belt form.

10. An image forming apparatus comprising:

a photo conductor;

a charger which charges said photo conductor to produce a charged photo conductor;

an exposer which forms a latent image on said charged photo conductor;

a developer which forms a visual image based on said latent image;

an intermediate transfer roller which temporarily carries said visual image by contacting with said photo conductor;

a fixing roller which fixes said visual image, which was transferred from said intermediate transfer roller, to a printing medium;

a toner supplier which supplies toner to said developer to be used in formation of said visual image;

a cleaner which cleans said intermediate transfer roller, said cleaner being constructed with a cleaning roller rotating in a direction opposite to a rotating direction of said intermediate roller, said cleaning roller further contacting with a surface of said intermediate transfer roller;

a plate form blade contacting with said cleaning roller at a predetermined position without contacting with said intermediate transfer roller; and a biasing member which urges said plate form blade onto said cleaning roller under pressure.

11. The image forming apparatus as claimed in claim 10 wherein said photo conductor is in a belt form.

12. An image forming apparatus comprising:

a photo conductor;

a charger which charges said photo conductor to produce a charged photo conductor;

an exposer which forms a latent image on said charged photo conductor;

a developer which forms a visual image based on said latent image;

an intermediate transfer roller which temporarily carries said visual image by contacting with said photo conductor;

a fixing roller which fixes said visual image, which was transferred from said intermediate transfer roller, to a printing medium;

a toner supplier which supplies toner to said developer to be used in formation of said visual image;

a cleaner which cleans said intermediate transfer roller, said cleaner being constructed with a cleaning roller rotating in a direction opposite to a rotating direction of said intermediate roller, said cleaning roller further contacting with a surface of said intermediate transfer roller; and a plate form blade contacting with said cleaning roller at a predetermined position without contacting with said intermediate transfer roller, said plate form blade being movable toward and away from said cleaning roller.

* * * * *